US005651167A

United States Patent [19]

Jovanovich

[11] Patent Number: 5,651,167

[45] Date of Patent: Jul. 29, 1997

[54] SIDE-ACTUATED CLIP

[76] Inventor: Radomir M. Jovanovich, 1700 Robin La., Glenview, Ill. 60025

[21] Appl. No.: 684,301

[22] Filed: Jul. 18, 1996

[51] Int. Cl.[6] ..... A44B 21/00

[52] U.S. Cl. ..... 24/502; 24/503; 24/509

[58] Field of Search ..... 24/502, 503, 509, 24/494, 495, 496, 498, 499, 114.05

[56] References Cited

U.S. PATENT DOCUMENTS

| | | | |
|---|---|---|---|
| 428,012 | 5/1890 | Lucas . | |
| 474,719 | 5/1892 | Brande . | |
| 581,810 | 5/1897 | Clarkson . | |
| 644,894 | 3/1900 | Carlin . | |
| 904,595 | 11/1908 | Barmore | 24/509 |
| 1,615,889 | 2/1927 | Senn | 24/509 |
| 1,634,532 | 7/1927 | Bowe . | |
| 2,596,635 | 5/1952 | Wolfe | 24/503 |
| 2,601,193 | 6/1952 | Wettley . | |
| 2,749,098 | 6/1956 | Johnson . | |
| 2,991,522 | 7/1961 | Balkind | 24/502 |
| 4,322,711 | 3/1982 | Spangler et al. . | |

*Primary Examiner*—Victor N. Sakran
*Attorney, Agent, or Firm*—Y. Judd Azulay, Esq.

[57] ABSTRACT

A side-actuated clip that is actuated by using only one hand. The clip consists of two halves, withone stationary and the other pivotal. A pivot shaft having a helical shape passes through a mounting bracket of the second, pivotal plate-half. The mounting bracket has an interior opening corresponding to the shape of the helically-shaped pivot shaft. The pivot shaft is spring biased. As the pivot shaft is translated in the mounting bracket secured to the second, pivotal plate-half, such movement causes the second plate-half to pivot open or closed, depending upon the direction of translation of the pivot shaft. The spring biases the shaft in a linear direction that pivots the second plate-half into its closed, clamping position.

12 Claims, 5 Drawing Sheets

SIDE-ACTUATED CLIP

BACKGROUND OF THE INVENTION

The present invention is directed to a clip, or clamp, having multiple uses, such as holding papers or documents together, or as an idendifying clip that may be worn on the person, or for use in any environment where a clip, or clamp, is necessary. Since prior-art clips or clamps generally require the use of two hands to operate, it is the intent and objective of the present invention to provide a clip, or clamp, that is operated, or actuated, by the use of just one hand, in order to allow easier use and operation.

SUMMARY OF THE INVENTION

It is the primary objective of the present invention to provide a spring-biased clip for holding articles, which clip is actuated to its opened, article-receiving position by the use of just one hand.

It is another objective of the present invention to provide such a spring-biased clip for holding articles, which clip is actuated to its opened, article-receiving position by squeezing together the ends of the clip.

It is yet another objective of the present invention to provide such a spring-biased clip for holding articles, such that by squeezing the ends of the clip, a spring-biased, screw-shaped, or helically-shaped, pivot pin is moved linearly through mating cross-sectioned bracket member, in opposition to the force of the spring, by which the linear movement of the pivot rod is translated into rotation movement of one of the two halves of the clip.

BRIEF DESCRIPTION OF THE DRAWINGS

The invention will be more readily understood with reference to the accompanying drawing, wherein.

DETAILED DESCRIPTION OF THE INVENTION

Figure 1:
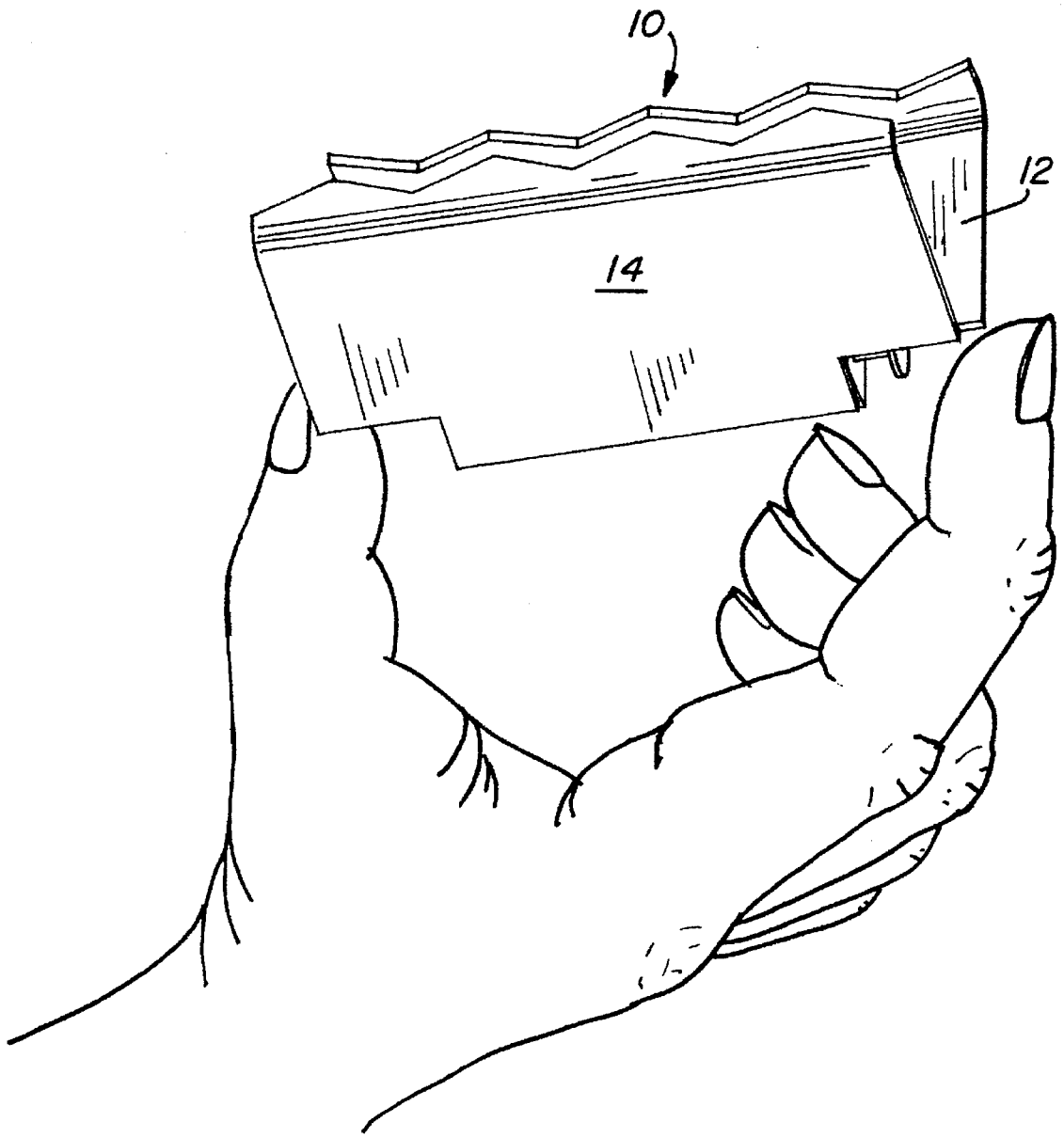
FIG. 1 is a perspective view of the side-actuated clip of the invention.
Figure 2:
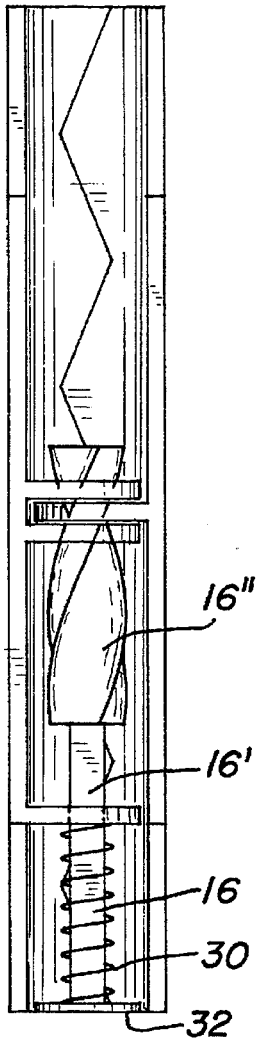
FIG. 2 is a bottom view of the clip of FIG. 1 showing the working parts thereof.
Figure 3:
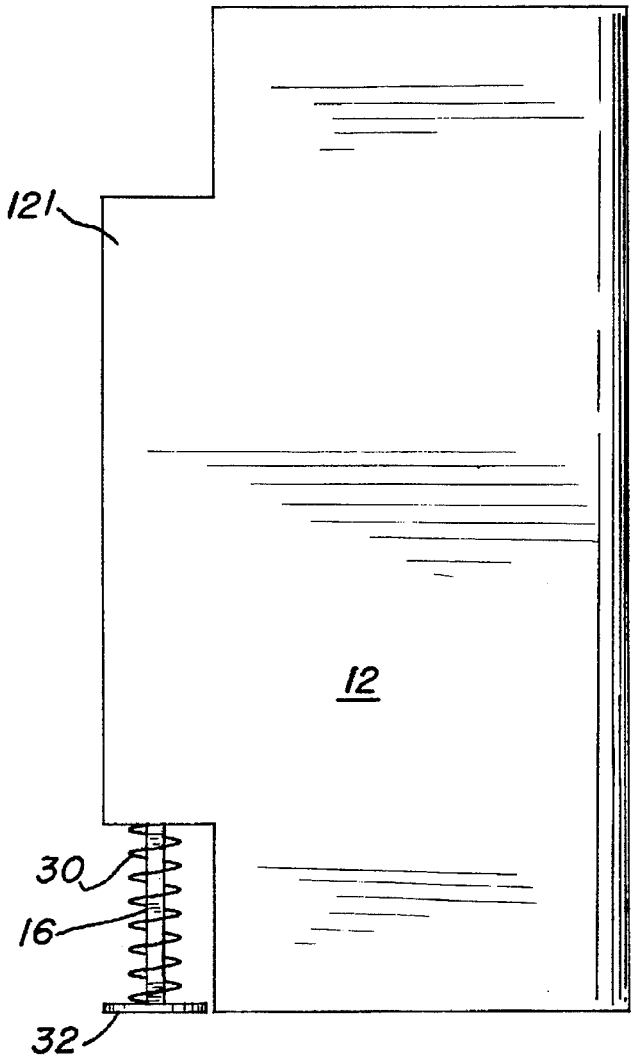
FIG. 3 is a side-elevational view thereof.
Figure 4:
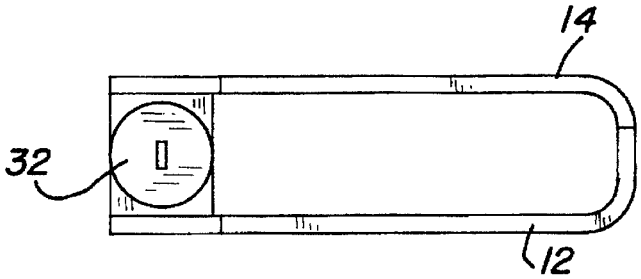
FIG. 4 is an end view thereof.
Figure 5:
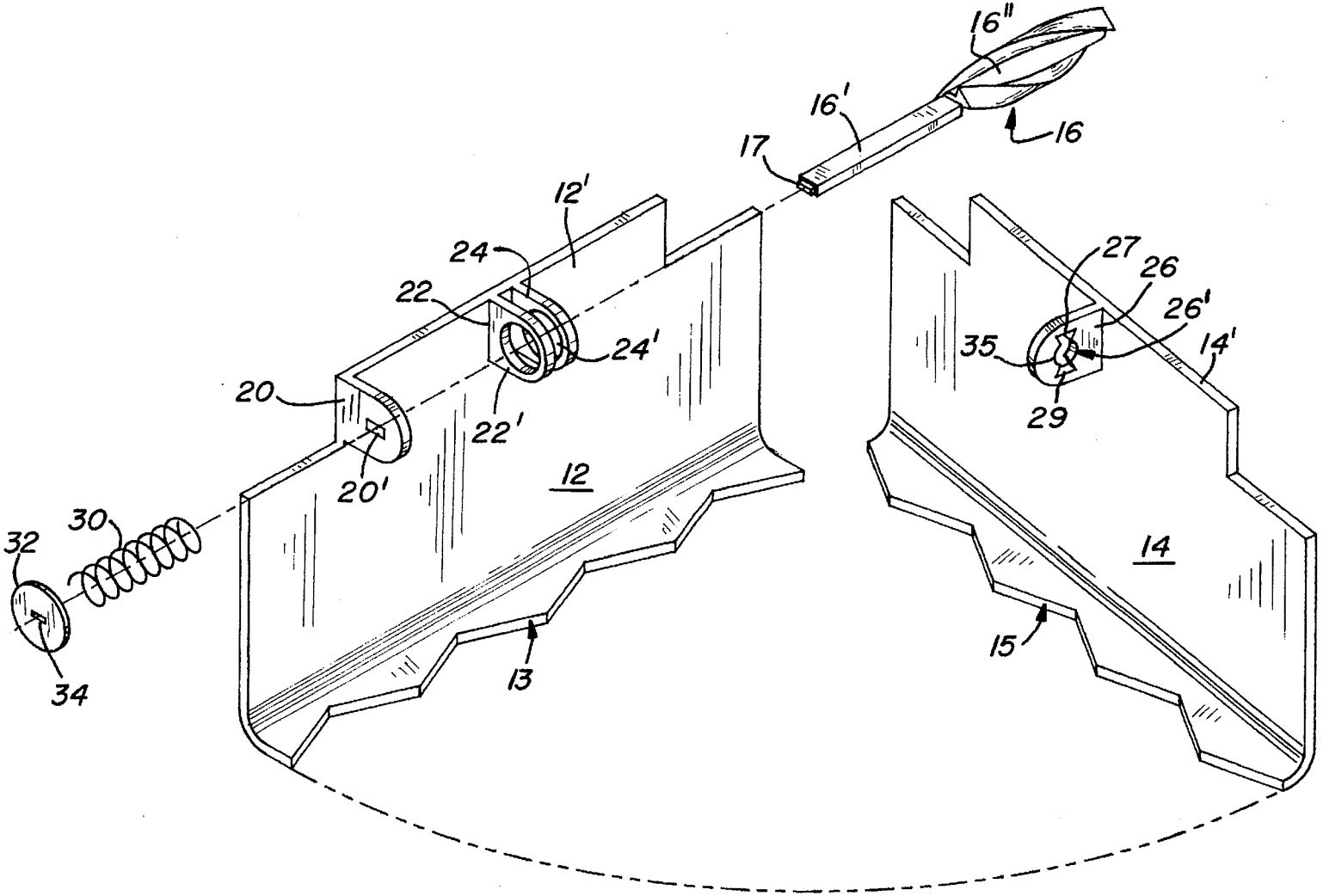
FIG. 5 is an assembly view, in persective, of the clip of FIG. 1.
Figure 6:
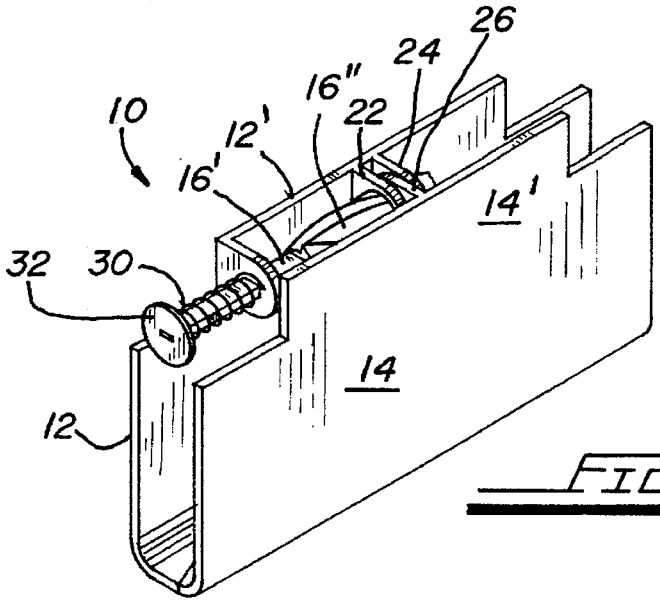
FIGS. 6–8 are isometric views of the clip of FIG. 1 showing the various stages of opening of the clip.

Referring now to the drawings in greater detail, the clip of the invention is indicated generally by reference numeral 10. The clip 10 has a pair of pivotally connected plate-halves 12, 14 which are spring-biased to their closed, contacting positions, as seen in FIGS. 4, and 6, with each plate-half having a lower clamping jaw 13, 15, respectively. The two plate-halves are pivotally, or rotatably, mounted to each other by means of a pivot pin, or shaft, 16. The first plate-half 12, for purposes of description, is considered the stationary plate-half, while the second plate-half 14 is the movable one. The first plate-half 12 is provided with a projecting, upper mounting section 12', to which corresponds a similar, projecting, upper mounting section 14' on the second plate-half 14. Protruding inwardly from the projecting, upper mounting section 12' are three bracket-mounts. A first bracket-mount 20 is located at the very edge of the projecting, upper mounting section 12', while the bracket-mounts 22, 24 are located approximately midway along the projecting, upper mounting section 12'. The two central bracket-mounts 22, 24 are spaced apart from each a distance that allows a fourth bracket-mount 26, protruding centrally and inwardly from the projecting, upper mounting section 14, to be received therebetween in a snug fashion. Each of the bracket-mounts 20, 24 has a central hole or cutout, through which passes pivot shaft 16. The bracket-mount 20 has a rectangularly-shaped, interior opening 20', which matches the cross-sectional shape of the first end-section 16' of the pivot shaft, as seen in FIG. 1. Each of the two central bracket-mounts 22, 24 has a circular interior opening 22', 24', respectively, which are of large enough diameter so as to pass the helically-shaped, or screw-shaped, cross section of the second end-section 16" of the pivot shaft 16, as seen in FIG. 1. The fourth bracket-mount 26 has an interior opening 26' having the same general shape as the planar cross section of the helically-shaped portion of the second end-section 16", so that a portion of the helically-shaped cross section of the second end-section 16" may be received snugly therein; that is, the interior opening 26' of the bracket-mount 26 has an upper, triangularly-shaped section 27, and a lower triangularly-shaped section 29, with a central, circular section 35.

The first end-section 16' of the pivot shaft 16 projects partially, laterally outwardly beyond the first bracket-mount 20. This partially-projecting portion of the end-section 16' is telescopingly received in a linear spring 30. The distal end 17 of the end-section 16' protrudes beyond the end of the spring 30, and is closed off by a cap 32 having a rectangularly-shaped interior opening, or cutout 34, as that of the bracket mount 20. The two ends of the spring are sandwiched between the cap 32 and the bracket-mount 20, whereby the spring 30 is placed in compression.

Figure 7:
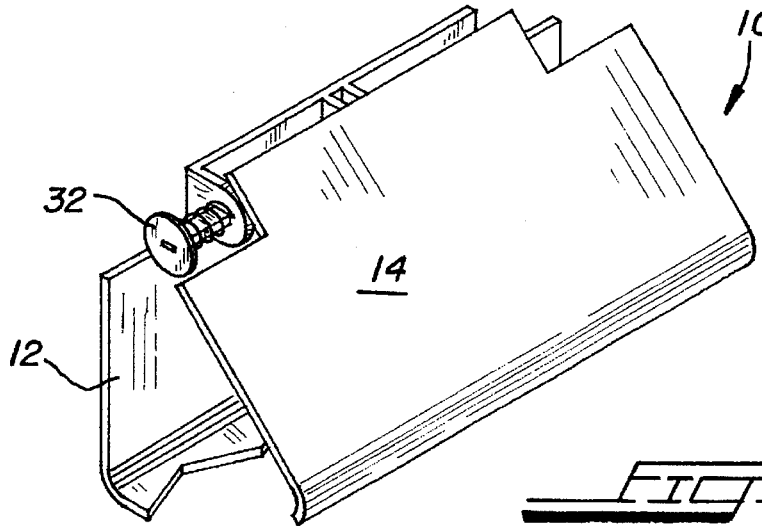
Figure 8:
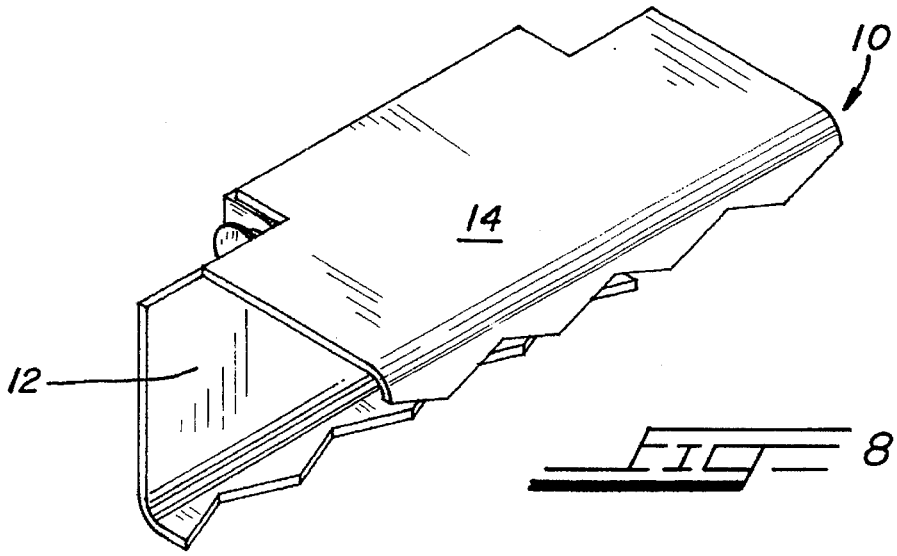
Figure 9:
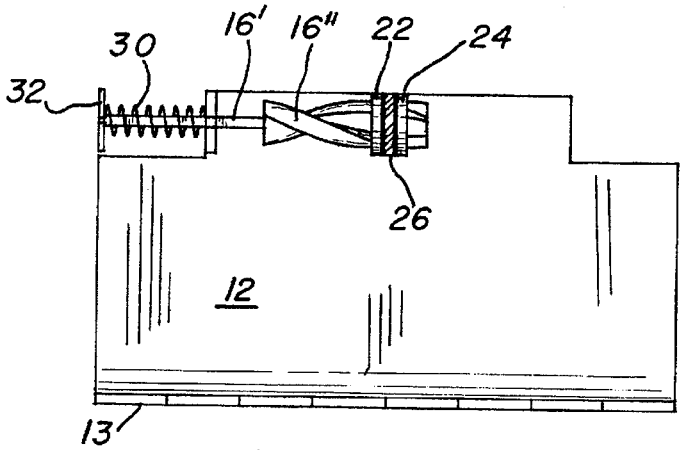
FIGS. 9–11 are partially-broken away front views showing the positioning of the linearly translating pivot rod, corresponding to the positions of FIGS. 6–8.
Figure 12:
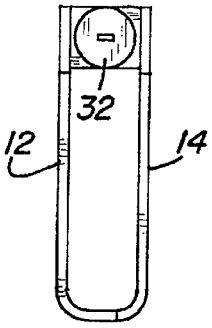
FIGS. 12–14 are end views thereof.
Figure 10:
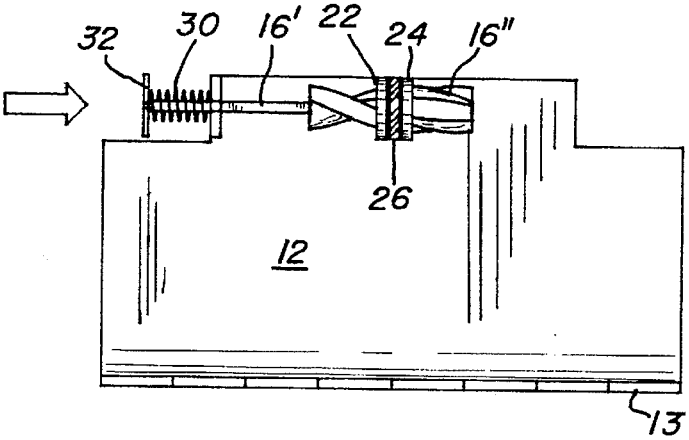
Figure 13:
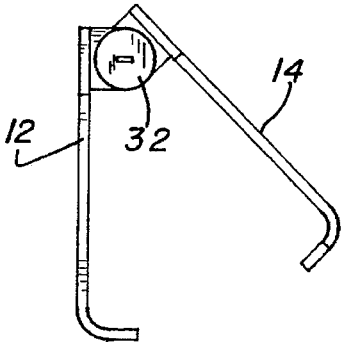
Figure 11:
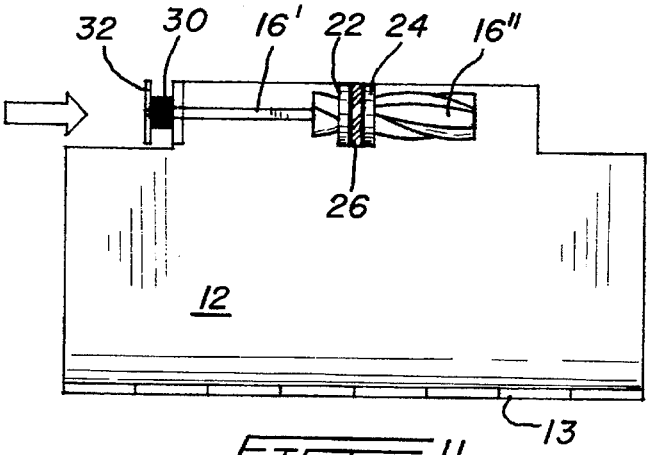
Figure 14:
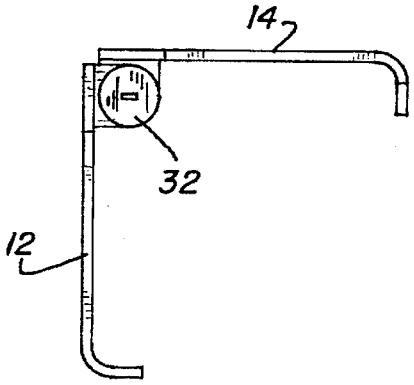

As may be seen when viewing FIGS. 9 and 12, in the static state of the clip 10, where no outside forces are applied, the linear spring 30 urges the cap 32 away from the bracket-mount 20, whereby the two plate-halves 12, 14 of the clip are forced into their closed, clamping position, where the clamping jaws 13, 15 thereof are in contact with each other to clamp an article therebetween. In order to open these jaws, and to pivot open the two plate-halves, one grips the clip 10 with just one hand, as seen in FIG. 1, with the thumb contacting the end-face of the clip opposite to that where the spring is located, and with the the forefinger contacting the cap 32. The person then squeezes the clip with hus hand, forcing the cap 32 to move toward the bracket-mount 20, which forces the pivot shaft to translate linearly through the bracket-mounts 20–26. The pivot shaft then passes through the interior openings of these bracket-mounts. However, since the interior of the bracket-mount 26 is of an approximate planar, helical, cross-sectional shape, as the pivot shaft translates through the opening 26', it forces the second plate-half 14 to pivot about the pivot shaft 16, in order for the planar, helical, cross-sectional shape of the opening 26' to match the helical, cross-sectional shape of the spin portion 16". To partially pivot open the second plate-half 14 by 45 degrees, as seen in FIGS. 7, 10 and 13, one moves the cap 32 approximately half the distance to the bracket-mount 20; to pivot open the second plate-half 14 a full 90 degrees, as seen in FIGS. 8, 11 and 14, one moves the cap 32 all the way against the bracket-mount 20. As soon as one releases the cap 32, the spring 31 automatically causes the second plate-half 14 to rotate back to its closing position.

While a specific embodiment of the invention have been shown and described, it is to be understood that numerous changes and modifications may be made therein without departing from the scope, spirit and intent of the invention as set forth in the appended claims. The above-described invention can also apply to any use of two pivotally-mounted plates, where one state thereof is preferred, and has use outside the clip or clamping arts. For example, the two plate-halves 12, 14 may constitute a switch. where the jaws 13, 15 are electrically conductive and close a circuit in their closed state, and open a circuit in their open state. Other uses are also envisioned.

What I claim is:

1. A clip, comprising:

A first, stationary clip-half having a first contacting surface;

a second, movable clip-half having a second contacting surface for abutting engagement with said first contacting surface;

a pivot shaft for pivotally mounting said first and second clip-halves together;

first bracket means on said first clip-half for mounting said first clip-half to said pivot shaft;

second bracket means on said second clip-half for mounting said second clip-half to said pivot shaft;

each of said bracket means having an interior opening for passing therethrough said pivot shaft;

said pivot shaft comprising at least a portion thereof having a screw-like cross section;

said second bracket means having an interior opening approximately the same as the planar cross section of said screw-like cross-sectioned portion of said pivot shaft; and biasing means for urging said pivot shaft in a first linear direction, whereby, upon moving said pivot shaft against the bias of said spring, said second, movable plate-half is rotated relative to said first plate-half.

2. The clip according to claim 1, wherein said first bracket means comprises a pair of closely spaced-apart bracket-mounts, each said bracket-mount having an interior opening of large enough size so as to freely pass said screw-like cross sectioned portion of said pivot shaft; said second bracket means comprising a third bracket-mount sandwiched between said pair of bracket-mounts on said first plate-half.

3. The clip according to claim 2, wherein each said interior opening of said pair of bracket-mounts is circular in shape.

4. The clip according to claim 2, wherein said first bracket means further comprises another bracket-mount; said pivot shaft comprising another portion thereof having a cross-sectional shape different form that of said screw-like cross sectioned portion thereof; said another bracket-mount having an interior opening of substantially the same shape as said cross section of said another portion.

5. The clip according to claim 4, wherein said another portion has a rectangular cross section, and said interior opening of said another bracket-mount is also rectangular.

6. The clip according to claim 2, wherein said first bracket means further comprises another bracket-mount; said pivot shaft comprising a protruding section thereof projecting laterally outwardly of said another bracket-means; said spring telescopingly surrounding said protruding section of said pivot shaft.

7. The clip according to claim 6, wherein said pivot shaft further comprises an end-cap secured to the end of said protruding section, said spring being sandwiched between said end-cap and said another bracket-mount.

8. The clip according to claim 7, wherein said end-cap has an interior opening, and said another bracket-mount has an interior opening; said interior openings of said end-cap and said another bracket-mount being approximately the same as the cross-sectional shape of said protruding section of said pivot shaft.

9. The clip according to claim 2, wherein each of said plate-halves comprises a bracket-mounting section for mounting the respective said bracket-mounts thereof, each said bracket-mounting section projecting from the remainder of the respective said plate-half; said remainder of each respective said plate-half having a length greater than the respective said bracket mounting section; said plate-halves being pivotally connected together by said pivot shaft and said bracket means at said bracket-mounting sections.

10. The clip according to claim 1, wherein said interior opening of said second bracket means comprises an upper, approximately triangularly-shaped section, a lower approximately triangularly-shaped section, and a middle circularly-shaped section.

11. The clip according to claim 1, wherein said first and second contacting surfaces are clamping jaws for use in clamping an article.

12. The clip according to claim 1, wherein said first and second contacting surfaces are electrical-connecting elements, whereby said clip may serve as an electrical switch.

* * * * *